United States Patent [19]

Kameya

[11] Patent Number: 4,570,136

[45] Date of Patent: Feb. 11, 1986

[54] ELECTROMAGNETIC DELAY LINE

[75] Inventor: Kazuo Kameya, Tsurugashima, Japan

[73] Assignee: Elmec Corporation, Tsurugashima, Japan

[21] Appl. No.: 686,399

[22] Filed: Dec. 26, 1984

[30] Foreign Application Priority Data

| | | | |
|---|---|---|---|
| Dec. 27, 1983 | [JP] | Japan | 58-247506 |
| Feb. 2, 1984 | [JP] | Japan | 59-19083 |
| Feb. 10, 1984 | [JP] | Japan | 59-17944 |

[51] Int. Cl.[4] ..... H01P 9/00

[52] U.S. Cl. ..... 333/161; 333/23; 333/140; 333/156

[58] Field of Search ..... 333/138–140, 333/156, 161–163, 23, 246

[56] References Cited

U.S. PATENT DOCUMENTS

| | | | |
|---|---|---|---|
| 2,462,410 | 2/1949 | Lindenblad | 333/156 |
| 2,776,411 | 1/1957 | Anderson | 333/140 |
| 3,320,555 | 5/1967 | Allen | 333/141 X |

FOREIGN PATENT DOCUMENTS 406685 3/1965 Japan .

OTHER PUBLICATIONS

MECL System Design Handbook, Motorola Inc., Fourth Edition 1983, pp. 44–45.

*Primary Examiner*—Marvin L. Nussbaum

*Attorney, Agent, or Firm*—Wegner & Bretschneider

[57] ABSTRACT

An electromagnetic delay line of a distributed constant type making use of a zigzag strip as a strip line and suitable for use in very high frequency ranges. The zigzag strip comprises electroconductive strips which are bent in such a manner that they are arranged on a first imaginary plane and a second imaginary plane parallel and opposite thereto and spaced apart therefrom by an interval of T, in an alternating manner, and the pitch P and the interval T are so related to each other that the ratio T/P is greater than zero and smaller than unity. Therefore the coupling produced in the zigzag strip is enhanced and the enhanced positive coupling controls negative coupling by reducing or canceling it.

8 Claims, 24 Drawing Figures

ELECTROMAGNETIC DELAY LINE

BACKGROUND OF THE INVENTION

1. Field of the Invention

The present invention relates to a distributed constant type electromagnetic delay line, and in particular to an improvement of such a type of electromagnetic delay line using a microstrip line and suitable for use in very high frequency ranges.

2. Description of the Prior Art

As an electromagnetic delay line of this kind there has been known a type using a microstrip line as shown in FIGS. 23 and 24 of the accompanying drawings. FIG. 23 is a partial perspective view of this electromagnetic delay line, and FIG. 24 is a partial sectional view thereof taken in a plane shown by the arrows XXIV—XXIV in FIG. 23. In this structure, the electroconductive strip is made by forming an electroconductive zigzag strip 5 which is bent back over a distance of W at intervals of P on one surface of a dielectric layer 3 whose other side is formed with a ground electrode 1.

An electromagnetic delay line of this structure is suitable for use in gigahertz bands and is adapted for compact design, but there is a limit to reduction in size and it has been difficult to achieve both super high speed and super compactness at the same time.

After studying the reasons for this, the inventor has discovered that the following are the factors which have prevented reduction in size.

In the above described electromagnetic delay line, a signal applied to the input end 7 is transmitted through the zigzag strip 5 in the direction indicated by the arrows. The zigzag strip 5 may be considered as being divided into a set of main electroconductive strips 9 which are disposed in parallel to the direction (the widthwise direction) perpendicular to the axial direction of the electromagnetic delay line, and a set of secondary electroconductive strips 11 which sequentially connect the main electroconductive strips 9 in series, and the electric current flowing through each of the main electroconductive strips 9 is opposite in direction to the electric current flowing through the one or two neighboring main electroconductive strips 9.

Considering the sectional view of FIG. 24, because the electric current flows in opposite direction as it flows through neighboring main electroconductive strips 9, the coupling coefficient between two immediately neighboring main electroconductive strips 9 has a negative value $-k1$, while two main electroconductive strips 9 separated by exactly one other main electroconductive strip 9 have a positive coupling coefficient $k2$ because the electric current flows in these two main electroconductive strips 9 take place in the same direction. Further, each certain main electroconductive strip 9 has coupling coefficients $-k3$, $k4$, . . . to other main electroconductive strips 9 which are displaced from that certain main electroconductive strip by two, three, . . . other intermediate electroconductive strips 9, because the electric current flowing through the main electroconductive strips 9 alternate in direction. As far as the absolute values of these coupling coefficients are concerned, they become smaller with an increase in the distance between the two main electroconductive strips 9 ($K1$ is greater than $K2$ is greater than $K3$ is greater than $K4$ . . . ).

And the effective inductance of each of the main electroconductive strips 9 is obtained by adding the effects of mutual induction determined by these coupling coefficients. Therefore, the effect of mutual induction is obtained by combination, and, taking into account the values and signs of these coupling coefficients, the combined value is always negative, and, to obtain the effective length of the zigzag strip 5 in this electromagnetic delay line, its actual length is to be reduced according to this combined negative value, and the delay time is accordingly reduced. Therefore, because it is necessary to compensate for the reduction in the effective strip length in order to obtain a desired delay time, size reduction of such an electromagnetic delay line is difficult. Furthermore, such an electromagnetic delay line having strong negative coupling not only tends to reduce the delay time but also gives rise to degradation of the flatness of the delay property and lowering of the cutoff frequency, thereby degrading the rise of the output pulse form.

In summary, electromagnetic delay lines using zigzag strips such as the shown zigzag strip 5 have been in existence in the industry in various forms, but there has been no electromagnetic delay line which has been analysed in terms of the values and the signs of various coupling coefficients, and none of the currently known types of electromagnetic delay line is sufficiently suitable for use in very high frequency ranges and very compact designs.

SUMMARY OF THE INVENTION

Accordingly, it is the primary object of the present invention to provide an extremely compact electromagnetic delay line, which is suitable for use in very high frequency ranges.

It is a further object of the present invention to provide such an electromagnetic delay line, which is suitable for use in designs where great compactness is required.

It is a further object of the present invention to provide such an electromagnetic delay line, which has good flatness of its delay property.

It is a further object of the present invention to provide such an electromagnetic delay line, which has a high cutoff frequency.

It is a further object of the present invention to provide such an electromagnetic delay line, which has a good rise of the output pulse form.

It is a yet further object of the present invention to provide such an electromagnetic delay line, which has a cheaply and easily manufacturable structure.

According to the most general aspect of the present invention, these and other objects are accomplished by an electromagnetic delay line comprising a laterally winding electroconductive strip having a longitudinal pitch of P and a ground terminal disposed opposite to the electroconductive strip with a dielectric body interposed therebetween: characterized in that: the electroconductive strip is defined on a first plane and a second plane which is parallel to the first plane and is spaced apart therefrom by an interval T, in an alternating manner for each laterally extending portion of the electroconductive strip; and the longitudinal pitch P and the distance T are selected so that the ratio T/P is greater than zero and smaller than unity.

According to such a structure, the positive coupling coefficients produced in the zigzag strip are enhanced, and these positive coupling coefficients appropriately reduce or cancel the negative coupling coefficients, thereby allowing control of the influences from these negative coupling coefficients. Therefore, it becomes easy to extend the effective length of the zigzag strip, and, while keeping the original performance of the microstrip line, and super high speed and super compactness can be achieved at the same time. Also, flatness of the delay property is good, and thereby the cutoff frequency is kept high, thus allowing a good rise of the output pulse form. Further, this electromagnetic delay line has a cheaply and easily manufacturable structure.

BRIEF DESCRIPTION OF THE DRAWINGS

The present invention will now be shown and described with reference to the preferred embodiments thereof, and with reference to the illustrative drawings, all of which are however given purely for the purposes of explanation and exemplification only and are not intended to be limitative of the scope of the present invention in any way. In the drawings, like parts and spaces and so on are denoted by like reference symbols in the various figures thereof; in the description, spatial terms are to be everywhere understood in terms of the relevant figure; and.

DESCRIPTION OF THE PREFERRED EMBODIMENTS

Before describing the embodiments of this invention, the principle of this invention is described in the following.

Figure 1:
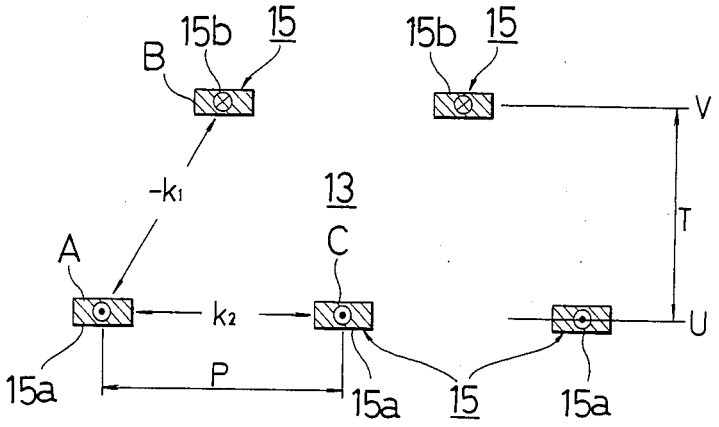
FIG. 1 is a vertical cross sectional view illustrating a proposed theory of the electromagnetic delay line according to this invention.

FIG. 1 shows a sectional view of a zigzag strip 13 forming the electromagnetic delay line according to this invention, to illustrate the principle of this invention. This zigzag strip 13 is comprised of main electroconductive strips 15 which are disposed parallel to the direction perpendicular to the axial direction of the electromagnetic delay line and secondary electroconductive strips connecting these in sequential manner, in the same way as the electromagnetic delay lines of the prior art shown in FIGS. 23 and 24 and described above, but only the main electroconductive strips 15 are shown in the sectional view of FIG. 1; thus, the secondary electroconductive strips, a ground electrode, and a dielectric layer which constitute other elements of this electromagnetic delay line are omitted from this drawing.

If the main electroconductive strips 15 through which the electric current flows from the plane of the drawing paper outward towards the viewer are termed the normal direction electroconductive strips 15*a*, while the main electroconductive strips 15 through which the electric current flows towards the plane of the drawing paper away from the viewer are termed the reverse direction electroconductive strips 15*b*, the zigzag strip 13 is formed by arranging the normal direction electroconductive strips 15*a* and the reverse direction electroconductive strips 15*b* as being bent back in an alternate manner at an interval of T and at a pitch of P. In other words, the central axes of the normal direction electroconductive strips 15*a* are disposed on an imaginary plane U and the central axes of the reverse direction electroconductive strips 15*b* are disposed on a second imaginary plane V which is disposed in parallel to and at the interval T away from the first imaginary plane U.

In the drawing, in regards to two of the normal direction electroconductive strips 15*a* and one of the reverse direction electroconductive strips 15*b* from the left to the right (three strips in all), which will be named as A, B, and C for convenience, the centers of these strips A, B, and C (in the sectional view of the drawing) may be located at the apices of an equilateral triangle by selecting the ratio of the interval T to the pitch P as 0.866 (approximately). In this case, because the distance between the electroconductive strips A and B and the distance between the electroconductive strips A and C are equal, the coupling coefficient K1 between the reverse direction electroconductive strip 15*b* and both of the normal direction electroconductive strips 15*a* and the coupling coefficient K2 between the neighboring normal direction electroconductive strips 15*a* are equal in magnitude. And it can be seen that K1 may be made smaller than K2 by setting the ratio of the interval T to the pitch P to be greater than 0.866, and K1 may be made greater than K2 by setting T/P smaller than 0.866. In other words, the relationship between the magnitudes of the coupling coefficients K1 and K2 changes by appropriately selecting the ratio of the interval T to the pitch P.

Therefore, when the density of the zigzag strip 13 is increased and the main electroconductive strips 15 are made closer to each other, it does not prevent the coupling becoming stronger, but it becomes possible to reduce or cancel the coupling coefficient K1 which strongly affects the properties of the electromagnetic delay line according to the other coupling coefficient K2, and the coupling coefficient K1 thus becomes effectively controllable. And it is obvious that if the ratio T/P is greater than zero, the effect of K2 cancelling K1 becomes stronger than the conventional case in which T/P equals zero. Further, the same effect is produced with regards to the coupling coefficient K3 and with regard to higher level coupling coefficients, even though the detailed explanation of these higher order effects is omitted here.

Therefore, it is possible to restrict the unfavorable influences described in connection with the conventional art and super high speed and super compactness can be achieved at the same time. And the characteristic impedance and the delay time obtained in an electromagnetic delay line using the zigzag strip 13 become closer to theoretically calculated values of straight microstrip line and super compactness becomes possible while maintaining the basic properties of a microstrip line, i.e. while maintaining good flatness of the delay property, a high cutoff frequency, and a good rise of the output pulse form.

Figure 2:
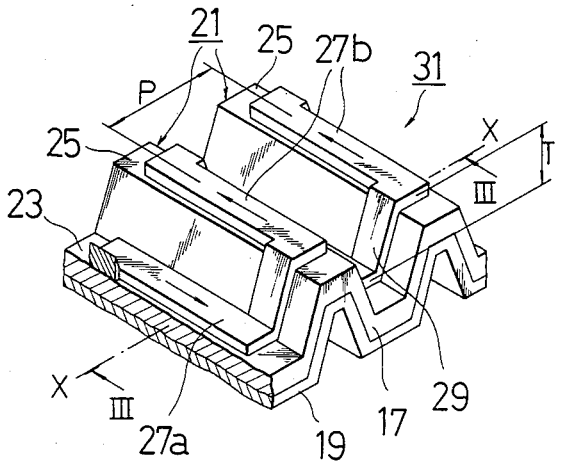
FIG. 2 is a partial perspective view showing a first preferred embodiment of the electromagnetic delay line of the present invention.
Figure 3:
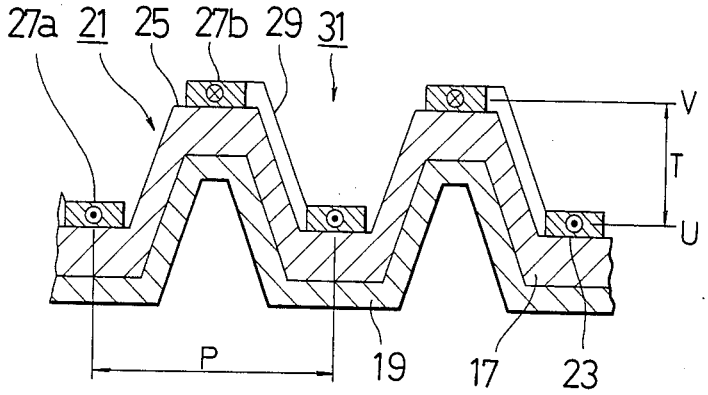
FIG. 3 is a partial sectional view of said first preferred embodiment, taken in a plane shown by the arrows III—III in FIG. 2.

FIGS. 2 and 3 show the first preferred embodiment of this invention.

In the drawings, the whole lower surface of a strip or layer of dielectric material 17 is formed with a ground terminal 19. The dielectric layer 17 and the ground terminal 19 are bent as a whole in a trapezoidal waveform defining peaks 21 and troughs 23 in an alternating manner. As for the upper surface of the dielectric layer 17, the upper surfaces of the peaks 21 are each formed with a reverse direction electroconductive strip 27*b* while the upper surfaces of the troughs 23 are each formed with a normal direction electroconductive strip 27*a*, and a secondary electroconductive strip 29 is formed on each of the slopes of the peaks 21 connecting the normal direction electroconductive strip 27*a* and the reverse direction electroconductive strip 27*b* in series, thereby forming the zigzag strip 31. In other words, the zigzag strip 31 is formed by bending back the normal direction electroconductive strip 27*a* and the reverse direction electroconductive strip 27*b* along the peaks and the troughs of one surface of the dielectric layer 17.

In this electromagnetic delay line, also, the plane containing the central axes of the normal direction electroconductive strips 27*a* is the first imaginary plane U, and the plane containing the central axes of the reverse direction electroconductive strips 27*b* is the second imaginary plane V, and the distance between these imaginary planes is the interval T. By setting the ratio T/P equal to 0.866, the rise time may be speeded up without reduction in the delay time, as compared to the case in which the interval T is equal to zero.

However, because in regards to the pulse response output waveform the delay time at a higher frequency range is smaller than in a lower frequency range, there is a tendency to produce a waveform which has a slightly large preshoot in response to a super high speed pulse input. And it has been discovered that the optimum pulse response output may be obtained when T/P is a value which is smaller than 0.866. This is because the influence of the coupling coefficient is stronger between electroconductive strips that are located further away from each other for the same coupling coefficient.

Further, it has been discovered that, even when the value of T/P is smaller than the value at which the optimum pulse response output is obtained, as long as the interval T and the pitch P are selected within the range in which T/P is greater than zero, it is possible to increase the delay time and to improve the rise time and the waveform distortion, as compared to the case in which T/P equals zero.

On the other hand, when the value of T/P is made greater than 0.866, the positive coupling becomes more enhanced, and the waveform distortion and the preshoot tend to become more pronounced, but in most application cases slight preshoot does not cause any practical problem. Further, when the positive coupling becomes substantially greater, the delay time of the zigzag strip 31 becomes greater than the theoretically calculated value, and thus such a construction is advantageous in this respect.

Therefore, in designing an electromagnetic delay line, the ratio T/P may be selected according to the desired application or purpose, and, by selecting T/P within the range in which T/P is greater than zero and is smaller than unity, it has been confirmed that the effect of this invention is useful for various purposes. Concrete experimental details will be described hereinafter.

Figure 4:
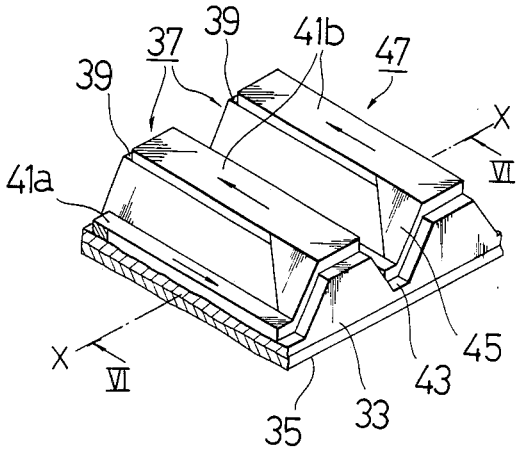
FIG. 4 is a partial perspective view showing a second preferred embodiment of the electromagnetic delay line of the present invention.
Figure 5:
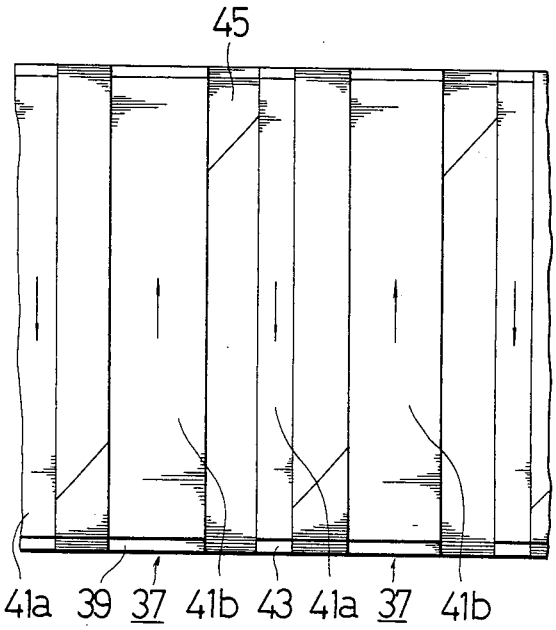
FIG. 5 is a partial plan view of said second preferred embodiment.
Figure 6:
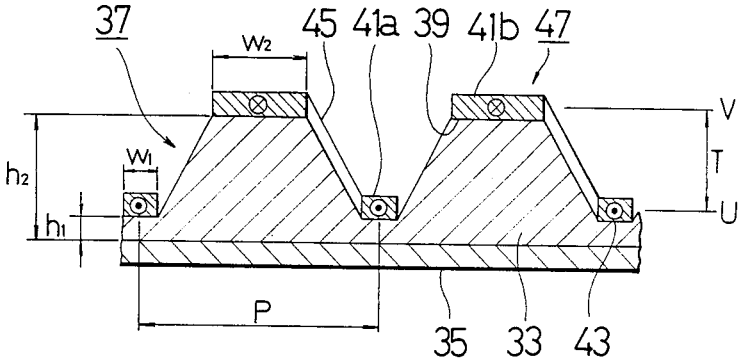
FIG. 6 is a partial sectional view of said second preferred embodiment, taken in a plane shown by the arrows VI—VI in FIG. 4.

FIGS. 4 to 6 show the second preferred embodiment of this invention.

In these drawings, the lower surface of the dielectric layer 33 is formed with a ground electrode 35 as a whole, while the upper surface of the dielectric layer 33 is formed with a plurality of trapezoidal portions 37 extending across the axial direction X—X of the electromagnetic delay line at a fixed interval. Therefore, the upper surface side of the dielectric layer 33 comprises thin portions and thick portions in an alternate manner.

The upper surface 39 of each of the trapezoidal portions 37 is formed with a reverse direction electroconductive strip 41*b* while each of the dips 43 between the two neighboring trapezoidal portions 37 is formed with a normal direction electroconductive strip 41*a*, and a zigzag strip 47 is formed by connecting these reverse direction electroconductive strips 41*b* and the normal direction electroconductive strips 41*a* with secondary electroconductive strips 45 which are formed on the slopes of the trapezoidal portions 37. In other words, the zigzag strip 47 is formed by bending back the normal direction electroconductive strips 41*a* and the reverse direction electroconductive strips 41*b* on one of the surfaces of the dielectric layer 33 over the thin portions and the thick portions in an alternate manner.

Because the thickness of the dielectric layer 33 is different between the reverse direction electroconductive strip 41*b* and the ground electrode 35 and between the normal direction electroconductive strip 41*a* and the ground terminal 35, the characteristic impedance is different for the normal direction electroconductive strip 41*a* portions and the reverse direction electroconductive strip 41*b* portions. Therefore, as shown in FIG. 6, the characteristic impedance is made uniform by making the width w1 of the normal direction electroconductive strips 41*a* smaller than the width w2 of the reverse direction electroconductive strips 41*b* while keeping the thicknesses of both the electroconductive strips 41*a*, 41*b* substantially equal. As for the secondary electroconductive strips 45, because they are formed on the slopes of the trapezoidal portions 37, their widths are varied along these slopes.

In the electromagnetic delay line of such a structure, the plane containing the central axes of the normal direction electroconductive strips 41*a* located in the dips 43 is the first imaginary plane U, while the plane containing the centers of the reverse direction electroconductive strips 41*b* located on the upper surfaces 39 of the trapezoidal portions 37 is the second imaginary plane V, and the distance therebetween, or in other words the difference h2 - h1 between the thicknesses h2 and h1 of the dielectric layer 33 at the normal direction electroconductive strips 41*a* and at the reverse direction electroconductive strips 41*b*, is the interval T. And the object of this invention can be achieved by selecting the relationship between the interval T and the pitch P within the range in which T/P is greater than zero and is smaller than unity.

Figure 7:
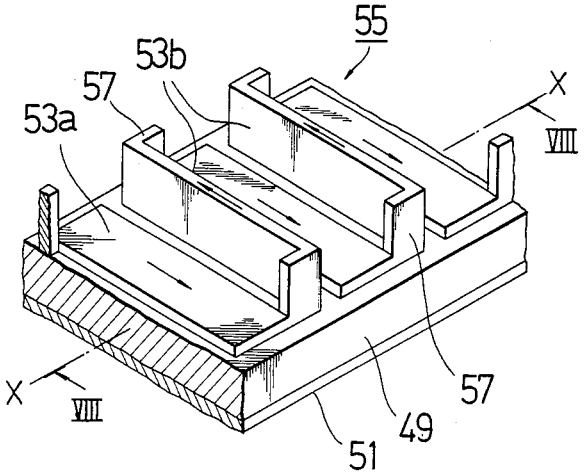
FIG. 7 is a partial perspective view showing a third preferred embodiment of the electromagnetic delay line of the present invention.
Figure 8:
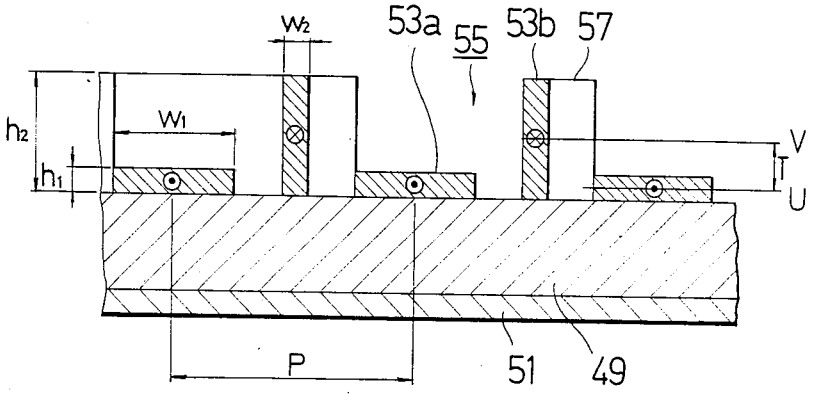
FIG. 8 is a partial sectional view of said third preferred embodiment, taken in a plane shown by the arrows VIII—VIII in FIG. 7.

FIGS. 7 and 8 show a third preferred embodiment of this invention.

This electromagnetic delay line comprises a ground terminal 51 formed over the whole lower surface of a strip or layer 49 of a dielectric, and a zigzag strip 55 is defined by bending back a set of relatively thick reverse direction electroconductive strips 53*b* and a set of relatively thin normal electroconductive direction strips 53*a* on the upper surface of the dielectric layer 49 so as to criss cross the axial direction X—X in an alternate manner.

In the electromagnetic delay line of such a structure, because the thickness h1 of the normal direction electroconductive strips 53*a* is smaller than the thickness h2 of the reverse direction electroconductive strips 53*b* even though the thickness of the dielectric layer 49 is constant, the difference (h2-h1)/2 arises between the centers of the reverse direction electroconductive strips 53*b* and the normal direction electroconductive strips 53*a*, and it is possible to utilize this difference substantially as the interval T. In other words, the central axes of the normal direction electroconductive strips 53*a* are located in the first imaginary plane U, while the central axes of the reverse direction electroconductive strips 53*b* are located in the second imaginary plane V. In the electromagnetic delay line of this structure, also, it suffices if the relationship between the interval T and the pitch P are selected appropriately so that T/P is greater than zero and is smaller than unity.

By setting the relationship between the width w1 of the normal direction electroconductive strips 53*a* and the width w2 of the reverse direction electroconductive strips 53*b* so that w1 is greater than w2, the same characteristic impedance is achieved for both the reverse direction electroconductive strip 53*b* portions and the normal direction electroconductive strip 53*a* portions.

According to this invention, it is possible to form an electromagnetic delay line which combines the concepts of the structures disclosed in FIGS. 4 through 6 and in FIGS. 7 and 8.

In the embodiments of the electromagnetic delay line so far described, a ground terminal is formed on one of the surfaces of the dielectric layer, while the electroconductive strips (the normal direction electroconductive strips and the reverse direction electroconductive strips) of the zigzag strip are bent back so that their cental axes lie in the first and the second imaginary planes which are displaced from one another by the interval T. However, the electromagnetic delay line of this invention is not to be considered as being limited by this, but may be implemented for instance as described hereinafter.

Figure 9:
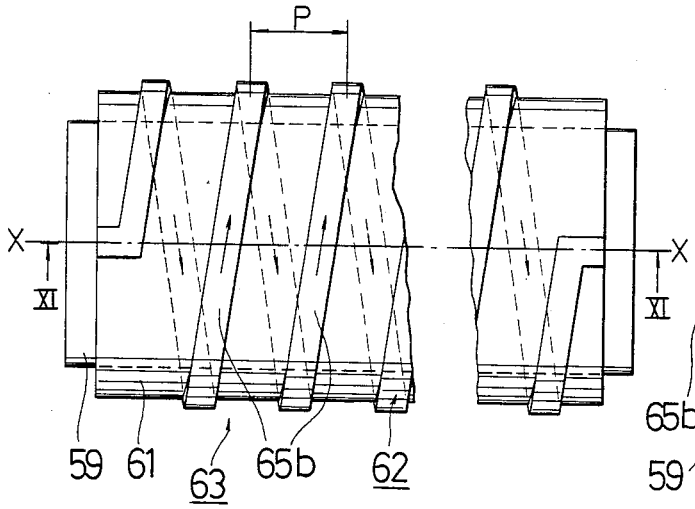
FIG. 9 is a partial plan view showing a fourth preferred embodiment of the electromagnetic delay line of the present invention.
Figure 10:
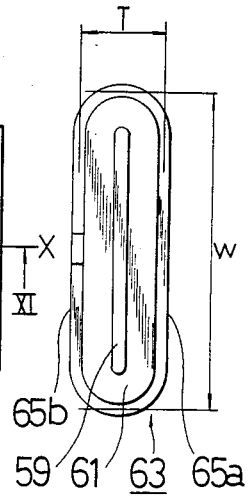
FIG. 10 is an end on view of said fourth preferred embodiment.
Figure 11:
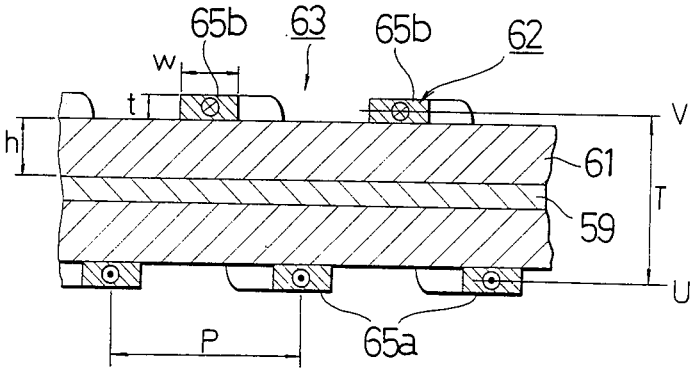
FIG. 11 is a partial sectional view of said fourth preferred embodiment, taken in a plane shown by the arrows XI—XI in FIG. 9.

FIGS. 9 to 11 show a fourth preferred embodiment of this invention.

In this electromagnetic delay line, a dielectric layer 61 is formed around a flat and elongated ground terminal 59, and an electroconductive strip 62 is wound around this dielectric layer 61 like a single layered solenoid at the winding pitch of P, using the dielectric layer as a flattened bobbin, thereby defining a zigzag strip 63 around the ground terminal 59 in opposition thereto.

In other words, in the electromagnetic delay line of such a structure, the plane containing the central axes of the normal direction electroconductive strips 65*a* (located on one side of the broader opposing surfaces of the dielectric layer 61) functions as the first imaginary plane U, while the plane containing the central axes of the reverse direction electroconductive strips 65*b* (located on the other side of the broader opposing surfaces of the dielectric layer 61) functions as the second imaginary plane V; and the relationship between the interval T and the pitch P is selected so that T/P is greater than zero and is smaller than unity.

The normal direction electroconductive strips 65*a* and the reverse direction electroconductive strips 65*b* are not disposed parallel to each other, but are disposed obliquely with respect to the axial direction X—X of the electromagnetic delay line, but this does not prevent the achievement of the objects of this invention.

Figure 12:
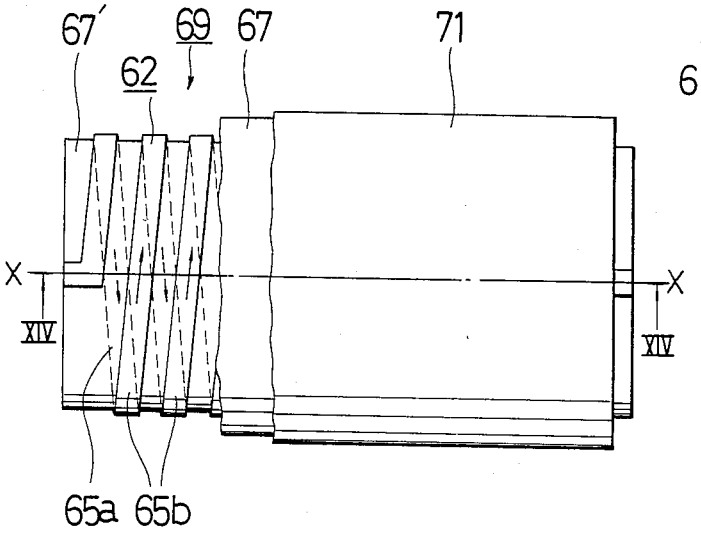
FIG. 12 is a partial plan view, partially broken away, showing a fifth preferred embodiment of the electromagnetic delay line of the present invention, said fifth embodiment being a variation of the fourth.
Figure 13:
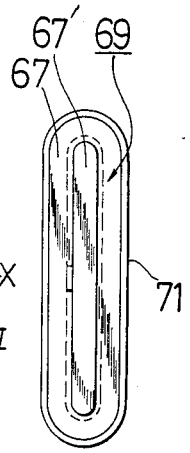
FIG. 13 is an end on view of said fifth preferred embodiment.
Figure 14:
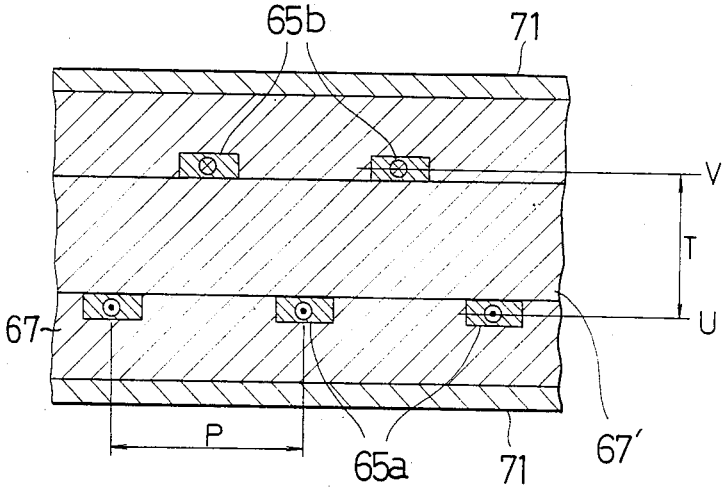
FIG. 14 is a partial sectional view of said fifth preferred embodiment, taken in a plane shown by the arrows XIV—XIV in FIG. 12.

FIGS. 12 to 14 show a fifth preferred embodiment of the electromagnetic delay line of the present invention, said fifth embodiment being a variation of the fourth.

In this construction, a zigzag strip 69 in the form of a flattened single layer solenoid is wound around a flattened dielectric bobbin 67′ and is then buried inside a flattened and elongated dielectric outer layer 67, and a ground terminal 61 covers the external circumference of the dielectric outer layer 67 in such a manner that the zigzag strip 69 is disposed inside the flattened and tubular ground terminal 71 with the dielectric outer layer 67 interposed therebetween.

The electromagnetic delay line of this structure may be considered as a variation of a strip line in which a single electroconductive strip is disposed between two ground electrodes with dielectric layers interposed therebetween. Further, because the zigzag strip 69 is shielded by the ground electrode 71, this electromagnetic delay line is relatively free from unfavorable coupling to an external circuit, and from noise, and is suitable to be built as a chip.

In this electromagnetic delay line, also, the relationship between the interval T and the pitch P of this zigzag strip 69 may be appropriately selected so that T/P is greater than zero and is smaller than unity.

Further, it is possible to form an electromagnetic delay line combining the concepts of the structures disclosed in FIGS. 9 through 11 and in FIGS. 12 through 14.

Thus with the electromagnetic delay line of this invention it is possible either to set the central axes of the electroconductive strips on the opposing surfaces of the dielectric layer and lying in the first and the second imaginary planes U and V, or to define the first imaginary plane U and the second imaginary plane V with the zigzag strip itself.

In the above described embodiments, it is possible to select the cross sectional shape of the electroconductive strips of the zigzag strip to be square, circular, or some other arbitrary shape. Further, the first and the second imaginary planes U, V are not actually required to be precisely planar.

Figure 15:
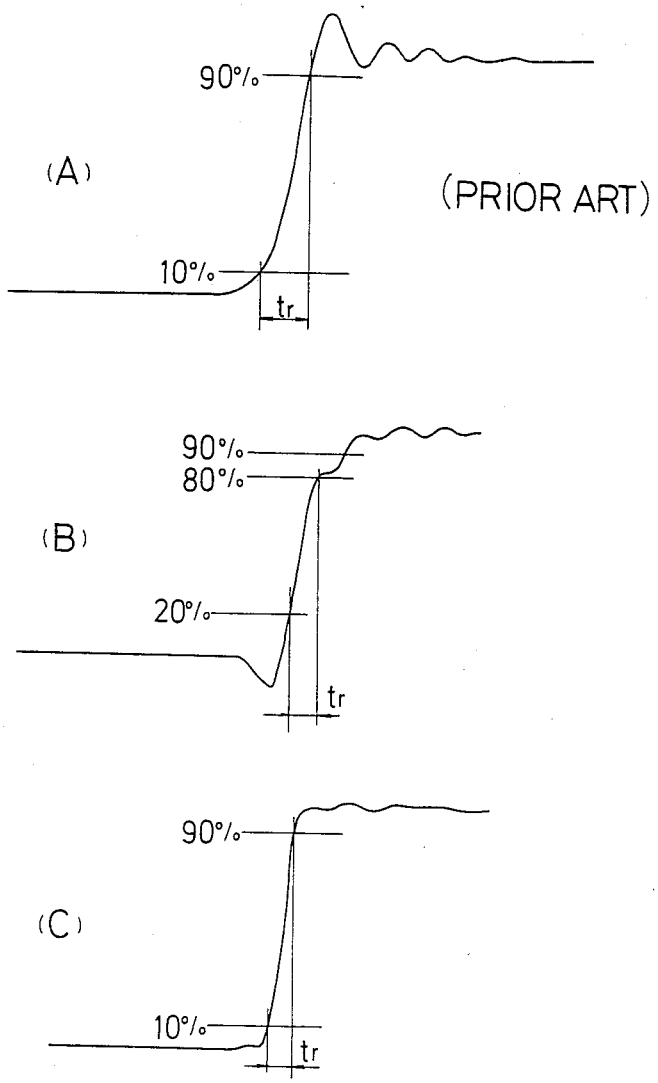
FIG. 15 shows certain pulse response output waveforms produced from the electromagnetic delay line.

FIG. 15 is a set of pulse response output waveforms which the inventor has actually measured in regards to an electromagnetic delay line of the above described structure.

Figure 23:
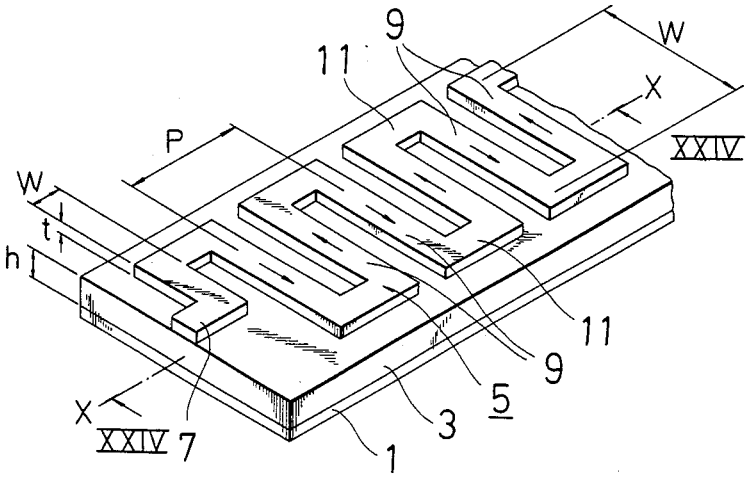
PRIOR ART FIG. 23
FIG. 23 is a partial perspective view of a prior art type of electromagnetic delay line.
Figure 24:
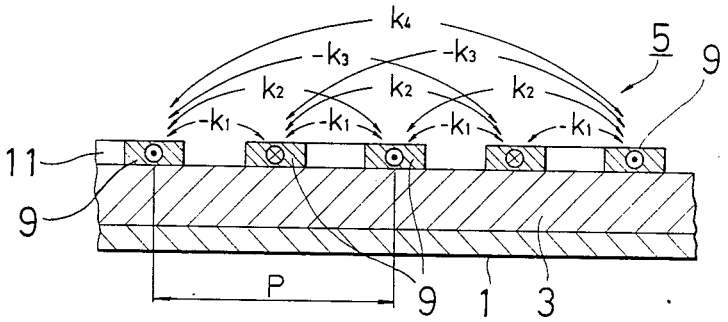
PRIOR ART FIG. 24
FIG. 24 is a partial sectional view of said prior art electromagnetic delay line, taken in a plane shown by the arrows XXIV—XXIV in FIG. 23.

FIG. 15A is obtained from an experiment with a conventional electromagnetic delay line like that of FIGS. 23 and 24, using a fluoreresin having a relative dielectric constant of 2.4 as the dielectric layer 3, with w (the width of the electroconductive strip) equal to 0.7 mm, t (the thickness of the electroconductive strip) equal to 0.035 mm, h (the thickness of the dielectric layer) equal to 0.33 mm, W (the length of the electroconductive strip) equal to 7.3 mm, and P (the pitch of the electroconductive strip) equal to 2 mm, with the zigzag strip 5 having ten pitches, and with the length of the zigzag strip 5 set to 166 mm. Then it was measured that the delay time td was equal to 640 ps, the rise time tr (from 10% to 90% of amplitude) was equal to 150 ps, and the characteristic impedance was equal to 52 ohms. Further, the figure of merit indicating the performance of an electromagnetic delay line, i.e. the ratio of the delay time td to the rise time tr, was 4.27, and the delay time was 14% less than the theoretically calculated value because of the influence from the negative coupling.

On the other hand, the present inventor conducted an experiment using an electromagnetic delay line having a structure as shown for instance in FIG. 9, having the following dimensions: length of the electroconductive strip equal to 215 mm, w equal to 0.9 mm, t equal to 0.035 mm, h equal to 0.33 mm, W equal to 10 mm, T equal to 1.35 mm, and P equal to 1.4 mm, and having ten pitches of zigzag strip 63 with T/P equal to 0.96. By testing the electromagnetic delay line according to this structure, the wave form shown in FIG. 15B was obtained. That is, the delay time td was equal to 1.06 ns, and with as described above T/P equal to 0.96 the waveform distortion of the preshoot became great and the shoulder after the rise showed some drooping. Therefore, it was not possible to measure the rise time tr by the normal method of measuring the time between 10% and 90% of the amplitude, but by measuring over the range between 20% and 80% of the amplitude it was found that the rise time tr' was equal to 70 ps and the characteristic impedance was 75 ohms. Further, the delay time was increased by 10% over the theoretically calculated value. Depending upon the applications of the electromagnetic delay line, for instance for delaying pulse signals for driving a logic circuit such as TTL (transistor-transistor logic) and ECL (emitter coupled logic) and so on, the rise time over the range between 20% and 80% of the amplitude may be considered important, and therefore the pulse waveform as shown in FIG. 15B may be sufficiently acceptable for practical purposes. However, when the ratio of the interval T to the pitch P is equal to or greater than unity, then the shoulder of the rise of the waveform drops below 80% of the amplitude and such a droop amount goes beyond the practical.

FIG. 15C shows the result of an experiment conducted with an electromagnetic delay line having a structure as shown in FIG. 9 with the dimensions: w equal to 0.5 mm, t equal to 0.035 mm, h equal to 0.63 mm, W equal to 13 mm, T equal to 1.4 mm, and P equal to 4 mm, and having ten pitches of zigzag strip 63 with T/P equal to 0.35, with the length of the electroconductive strip equal to 280 mm. And it was measured that the delay time td was equal to 1.24 ns, the rise time tr was equal to 70 ps, the characteristic impedance was equal to 110 ohms, and the figure of merit td/tr indicating the performance of the electromagnetic delay line was equal to 17.7, thus showing that the electromagnetic delay line displayed extremely favorable values as a whole. The delay time is about 1% smaller than the theoretically calculated value, but because the values are more or less similar and the rise time is faster with very little waveform distortion this invention has produced very favorable results.

Figure 16:
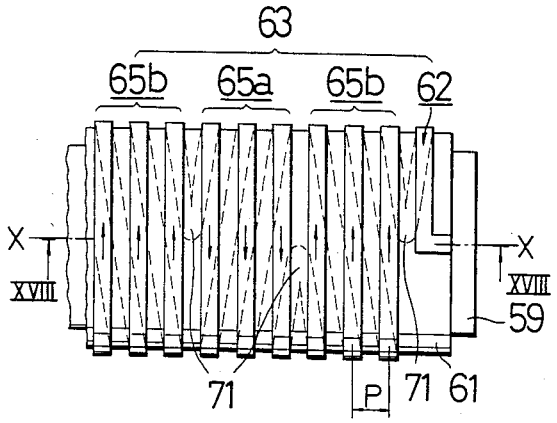
FIG. 16 is a partial plan view showing a sixth preferred embodiment of the electromagnetic delay line of the present invention, said sixth embodiment again being a variation of the fourth.
Figure 17:
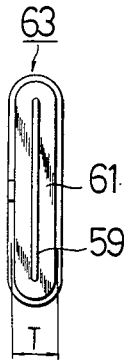
FIG. 17 is an end on view of said sixth preferred embodiment.

FIGS. 16 and 17 show a sixth preferred embodiment of the electromagnetic delay line of the present invention, said sixth embodiment again being a variation of the fourth.

In these drawings, a dielectric layer 61 is formed around an elongated ground plane 59 presenting a flattened shape as a whole. An electroconductive strip 62 is wound over the opposing surfaces of the dielectric layer 61 in the form of a single layer solenoid with the pitch P, thus defining a zigzag strip 63. This zigzag strip 63 is formed with continuously changing directions in the normal direction and the reverse direction in an alternate manner. In other words, three of the reverse direction electroconductive strips **65*b* and another three of the normal direction electroconductive strips 65*a* are disposed around the dielectric layer 61 above the ground plane 59, and bent back portions 71 of the normal and reverse direction electroconductive strips 65*a*, 65*b* are formed below the ground plane 59**.

Figure 18:
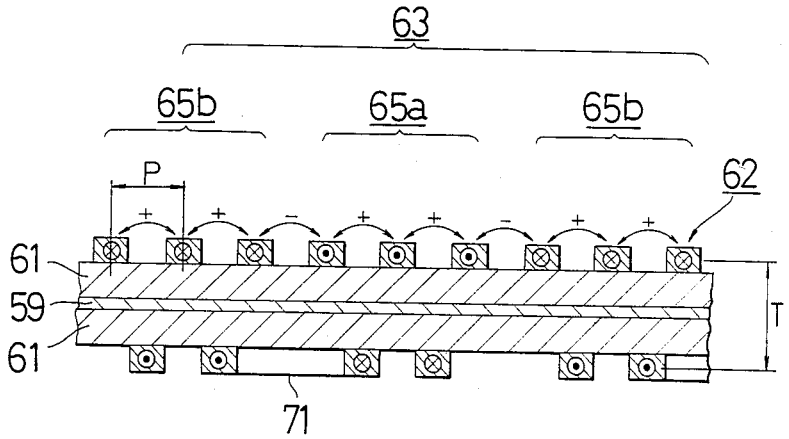
FIG. 18 is a partial sectional view of said sixth preferred embodiment, taken in a plane shown by the arrows XVIII—XVIII in FIG. 16, for showing the coupling relationships therein.

The coupling relationship in this electromagnetic delay line is as indicated in FIG. 18, such that the coupling between the neighboring reverse direction electroconductive strip **65*b* above the ground plane 59 is positive and the coupling between the normal direction electroconductive strips 65*a* is likewise positive for the same reason. On the other hand, the coupling between the reverse direction electroconductive strip 65*b* and the normal direction electroconductive strip 65*a* is negative and the positive couplings and the negative couplings are arranged in the ratio of two to one. Even though the directions of the electric current flowing through the normal and the reverse direction electroconductive strips 65***a*, 65*b* before and after the bent back portion 71 below the ground plane in the cross sectional view of FIG. 18 cannot be directly expressed, nevertheless by looking at the direction of the electric current in the electroconductive strips indicated by broken lines in FIG. 16 it can be seen that the distribution or arrangement of the positive and negative couplings is two to one in the same way as in the corresponding portion above the ground plane 59.

In this electromagnetic delay line, the positive coupling becomes extremely stronger by reducing the pitch P of the normal and reverse direction electroconductive strips 65*a*, 65*b*. However, by interposing negative couplings at some appropriate ratio it becomes possible to partly cancel excessively strong positive couplings with negative couplings and to control the effect of the positive couplings at some appropriate level. In other words, as a means for cancelling strong negative coupling which is the shortcoming of the conventional zigzag strip 5 as shown in FIGS. 23 and 24, this zigzag strip is formed by being wound in the manner of a single layer solenoid. Further, as a second means for accomplishing super compactness, doubling the coupling coefficient control function is produced by producing negative coupling for restraining positive coupling by winding part of the electroconductive strip 62 in the reverse direction. Because in such an electromagnetic delay line it is possible to control excessive positive coupling, it becomes possible to further reduce the pitch P of the electroconductive strip 62 in the zigzag strip 63, and thereby achieve super compactness.

In actually implementing this electromagnetic delay line, as well as arranging three normal direction electroconductive strips 65*a* and three reverse direction electroconductive strips 65*b* on one surface of the dielectric layer 61, it is possible to combine them so that the ratio between the positive coupling and the negative couplings becomes two to two, four to four, five to five, and so on, and thus to produce a desired difference in the positive and negative coupling ratios.

Figure 19:
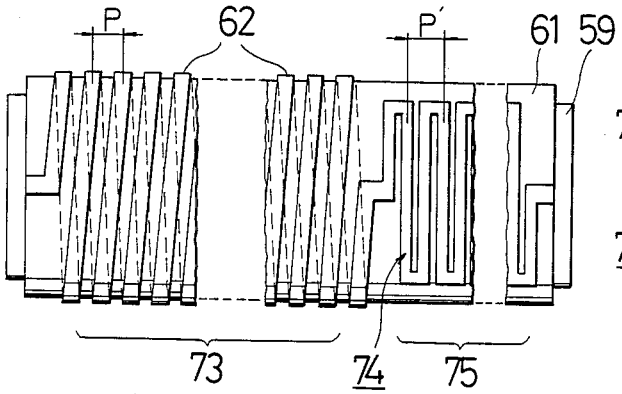
FIG. 19 is a plan view of a composite electromagnetic delay line which includes as a component part the electromagnetic delay line of FIG. 9.
Figure 20:
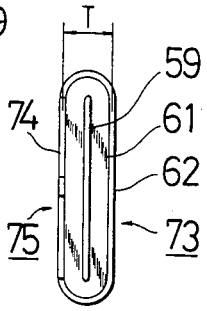
FIG. 20 is an end view of the composite delay line of FIG. 19.

FIGS. 19 and 20 show an application of the electromagnetic delay line shown in FIG. 9. In these drawings, a first zigzag electroconductive strip 73 is formed around a lengthwise portion of the dielectric layer 61 by winding an electroconductive strip 62. And a second zigzag strip 75 is made by bending back an electroconductive strip 74 at a pitch P′, extending continuously from the first zigzag strip 73 on one surface of the lengthwise remaining portion of the dielectric layer 61. Thus a composite electromagnetic delay line is made up.

In such a composite electromagnetic delay line, as the pitch P of the electroconductive strip 62 of the first zigzag strip 73 is reduced, the positive coupling becomes stronger as described above, and the flatness of the delay property becomes worse. On the other hand, as the pitch P′ of the electroconductive strip 74 of the second zigzag strip 75 is reduced, the negative couplings become stronger as in conventional electromagnetic delay lines, and the flatness of the delay property becomes worse. However, because the worsening of the flatness of the delay properties are opposite in direction in regards to the first zigzag strip 73 and the second zigzag strip 75, and therefore it is possible to complement their properties by connecting them in series.

Therefore, it becomes possible to speed up the rise time and reduce the waveform distortion even when the pitches P, P′ of the electroconductive strips 62, 74 are reduced, and to achieve super compactness. As for delay time, the delay time td of the second zigzag strip 75 portion becomes less than the actual dimensional length as the delay time td of the first zigzag strip portion 73 becomes greater. All in all, it is possible to obtain a delay time which is close to a theoretically calculated value. Therefore, it is possible to increase the delay time td by reducing the pitches P, P′ of the electroconductive strip portions 62, 74 of the first and the second zigzag strips 73, 74 and to increase the dimensional lengths of the electroconductive strips 62, 74 by increasing the number of windings of the electroconductive strips 62, 74.

Figure 21:
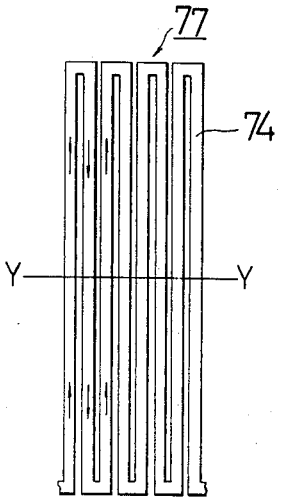
FIG. 21 is an unfolded view of an alternative construction for another part of the composite electromagnetic delay line of FIGS. 19 and 20.
Figure 22:
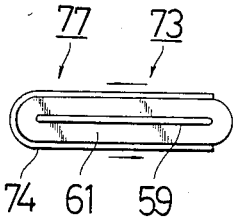
FIG. 22 is an end view of said alternative construction.

FIGS. 21 and 22 show another possible construction for the second zigzag strip 75. In this construction, the zigzag strip 75 of FIG. 19 is formed on both the surfaces of the dielectric layer 61. In other words, as shown in FIG. 21 which is an unfolded view, the second zigzag strip 77 shown as being formed in a plane is bent into a C-shape about an imaginary line Y—Y passing across the center of each of the electroconductive strips 74, and, as shown in FIG. 22, is continuously formed on the opposing surfaces of the dielectric layer 61.

In the second zigzag strip 77 thus structured, the directions of the electric current not only between the neighboring electroconductive strip 74 but also between the electroconductive strips 74 which are closest to each other across the opposing surfaces of the dielectric layer 61 are reversed or opposite to each other, and the negative coupling becomes stronger. Therefore, because the second zigzag strip 77 has extremely strong negative coupling, by connecting the second zigzag strip 77 to the first zigzag strip 73 it is possible to enhance their mutually complementing effect, and even greater compactness becomes possible.

As the first zigzag strip 73, it is possible to use any one of the electromagnetic delay lines so far described. The arrangements of the first zigzag strip 73 and the second zigzag strip 77 are arbitrary in their number and order, as long as they are arranged in an alternate manner. Further, the first zigzag strip 73 and the second zigzag strip 77 may be formed separately.

The electromagnetic delay line according to this invention so far described may be used itself, but also may be used as a variable delay line.

Although the present invention has been shown and described with reference to the preferred embodiments thereof, and in terms of the illustrative drawings, it should not be considered as limited thereby. Therefore it is desired that the scope of the present invention should be defined not by any of the perhaps purely fortuitous details of the shown preferred embodiments, or of the drawings, but solely by the scope of the appended claims, which follow.

What is claimed is:

1. An electromagnetic delay line comprising:

an elongate dielectric member having first and second surfaces, a ground electrode disposed on said first surface of said dielectric member, an undulating conductor disposed on said second surface of said dielectric member, said undulating conductor comprising a lateral set of electroconductive strips spaced longitudinally of said dielectric member and extending perpendicularly of the longitudinal axis of said dielectric member and a longitudinal set of electroconductive strips extending parallel to the longitudinal axis of said dielectric member connecting ends of said lateral strips to form a continuous electrical path having a longitudinal pitch P, said lateral strips being, respectively, alternately disposed on first and second vertically separated planes, which planes are parallel to the longitudinal axis of said dielectric member and are vertically separated by an interval T, said longitudinal pitch P and vertical interval T being selected so that the ratio T/P is greater than zero and smaller than unity.

2. An electromagnetic delay line according to claim 1 wherein the longitudinal cross-section of said elongate dielectric member is wave-shaped and of substantially uniform thickness, said wave shape have peaks and troughs defining, respectively, said first and second planes.

3. An electromagnetic delay line according to claim 1 wherein said elongate dielectric member in its longitudinal cross-section has relatively thicker and thinner portions forming peaks and troughs, said peaks and troughs being spaced alternately along the length of said dielectric member and wherein said first and second planes are, respectively, defined by said peaks and troughs.

4. An electromagnetic delay line according to claim 1 wherein said undulating conductor is arranged around said ground electrode and wherein said dielectric member is placed therebetween to thereby define a single-layered solenoid-like structure.

5. The electromagnetic delay line according to claim 1 wherein said ground electrode is of a substantially hollow tubular shape and wherein said undulating conductor is placed within the interior of said hollow tubular ground electrode and wherein said dielectric body is interposed therebetween.

6. The electromagnetic delay line according to claim 4 wherein the direction of winding of said undulating conductor is reversed in direction at an intermediate point thereof.

7. The electromagnetic delay line according to claim 5 wherein the winding of the undulating conductor strip is reversed in direction at an intermediate point thereof.

8. The electromagnetic delay line according to claim 1 wherein said longitudinal electroconductive strips are placed only on a plane which is coplanar to one of said first and second planes.

* * * * *